US008128429B2

(12) United States Patent
Suzuki

(10) Patent No.: US 8,128,429 B2
(45) Date of Patent: Mar. 6, 2012

(54) FPC U-SHAPED NAIL

(75) Inventor: Teruhito Suzuki, Koza-gun (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/000,093

(22) PCT Filed: Jun. 22, 2009

(86) PCT No.: PCT/IB2009/007146

§ 371 (c)(1),
(2), (4) Date: Dec. 20, 2010

(87) PCT Pub. No.: WO2010/004439

PCT Pub. Date: Jan. 14, 2010

(65) Prior Publication Data

US 2011/0104938 A1 May 5, 2011

(30) Foreign Application Priority Data

Jun. 20, 2008 (JP) ..... 2008-162528

(51) Int. Cl.
*H01R 12/24* (2006.01)

(52) U.S. Cl. ..... 439/493; 439/261

(58) Field of Classification Search ..... 439/493, 439/494, 495, 260, 261
See application file for complete search history.

(56) References Cited

U.S. PATENT DOCUMENTS

| | | | | |
|---|---|---|---|---|
| 7,083,455 | B1 * | 8/2006 | Miura et al. | 439/495 |
| 7,473,125 | B2 * | 1/2009 | Murakami | 439/495 |
| 7,833,046 | B2 * | 11/2010 | Tamura et al. | 439/422 |
| 2003/0220013 | A1 | 11/2003 | Lee | |

FOREIGN PATENT DOCUMENTS

| | | | |
|---|---|---|---|
| EP | 1 890 362 | A1 | 2/2008 |
| JP | 7-16384 | | 3/1995 |
| WO | WO 2007/076148 | A1 | 7/2007 |

OTHER PUBLICATIONS

International Search Report for PCT/IB2009/007146.

* cited by examiner

*Primary Examiner* — Tulsidas C Patel
*Assistant Examiner* — Travis Chambers
(74) *Attorney, Agent, or Firm* — Timothy M. Morella

(57) ABSTRACT

To provide an electric connector capable of securing a sufficient distance between a position at which a projecting portion of a flat electric cable is placed and a position soldered on the surface of a circuit board even when the electric connector is formed having a low profile an electric connector, for connecting an FPC, having a projecting portion formed on an edge thereof, to a circuit board, is disclosed. The electric connector has a plurality of terminals, a housing, and a reinforcing member fixed to the housing. The reinforcing member has a pull-out stop portion positioned outside in the width direction of the FPC relative to the plurality of terminals, and a fixed portion positioned apart from the pull-out stop portion toward the outside in the width direction of the FPC and fixed on the surface of the circuit board.

8 Claims, 17 Drawing Sheets

FPC U-SHAPED NAIL

BACKGROUND

1. Field

The present disclosure relates to an electric connector for connecting a flat electric cable to a circuit board.

2. Description of the Related Art

Electric connectors for connecting a flat electric cable, such as a flexible flat cable, a flexible printed circuit (hereinafter referred to as an FPC) and the like, to a circuit board include an electric connector having a reinforcing member for increasing the strength in fixing the electric connector to the circuit board. In such an electric connector, not only the terminal but also the reinforcing member is soldered on the surface of the circuit board, thereby increasing the strength in fixing the electric connector on the circuit board.

Conventionally, in order to prevent a flat electric cable, such as an FPC and the like, from being removed from the electric connector, there has been proposed an electric connector having a reinforcing member formed so that the electric cable is caught thereon. For example, the electric connector described in Japanese Patent Application Publication No. 2007-299554 has a plate-like reinforcing member with a lower edge to be soldered on the surface of the circuit board. The upper edge of the reinforcing member is formed with a recess on which a projecting portion, formed on a side edge of an electric cable, can be placed. With the projecting portion fitted in the recess, the electric cable is prevented from being removed.

PROBLEMS TO BE SOLVED BY THE DISCLOSURE

For the electric connector disclosed in the above-described Japanese Patent Application, it is necessary that a sufficient distance be secured between the lower edge of the reinforcing member and a portion that forms the bottom edge of the recess so that the recess is not filled due to solder wicking when soldering; that is, to ensure that the solder on the lower edge of the reinforcing member does not reach the bottom edge of the recess. However, as the up-down width of the reinforcing member has recently become smaller due to low-profiling of electric connectors, there may be a case in which the sufficient distance cannot be secured between the bottom edge of the recess and the lower edge of the reinforcing member.

The present disclosure addresses the above-mentioned problems. An object thereof is to provide an electric connector for preventing a flat electric cable from being removed, by means of a reinforcing member, in which a sufficient distance can be secured between a portion on which a projecting portion of an electric cable is placed and a portion soldered on the surface of the circuit board.

In order to attain the above described object, there is provided an electric connector for connecting a flat electric cable having a projecting portion formed on a side edge thereof to a circuit board, the projection portion comprising a plurality of terminals arranged in a width direction of the electric cable; a housing retaining the plurality of terminals arranged in the width direction; and a reinforcing member fixed to the housing. The reinforcing member includes a pull-out stop portion positioned outside in the width direction relative to the plurality of terminals and formed so that the projecting portion of the electric cable is able to be placed on the pull-out stop portion. Also, the reinforcing member includes a stopper portion formed so that the projecting portion on the pull-out stop portion is caught on the stopper portion, and a connecting portion extending from the pull-out stop portion toward outside in the width direction. Furthermore, the reinforcing member includes a fixed portion which is positioned apart from the pull-out stop portion toward outside in the width direction, being continuous from the connecting portion, and is fixed on a surface of the circuit board.

According to the present disclosure, as a fixed portion is positioned away from the pull-out stop portion to the outside in the width direction of an electric cable, a sufficient distance can be secured between a portion on which a projecting portion of the electric cable is placed and a portion soldered on the surface of the circuit board, even in the case where the electric connector is formed having a low profile.

DESCRIPTION OF THE PREFERRED EMBODIMENTS

Figure 1:
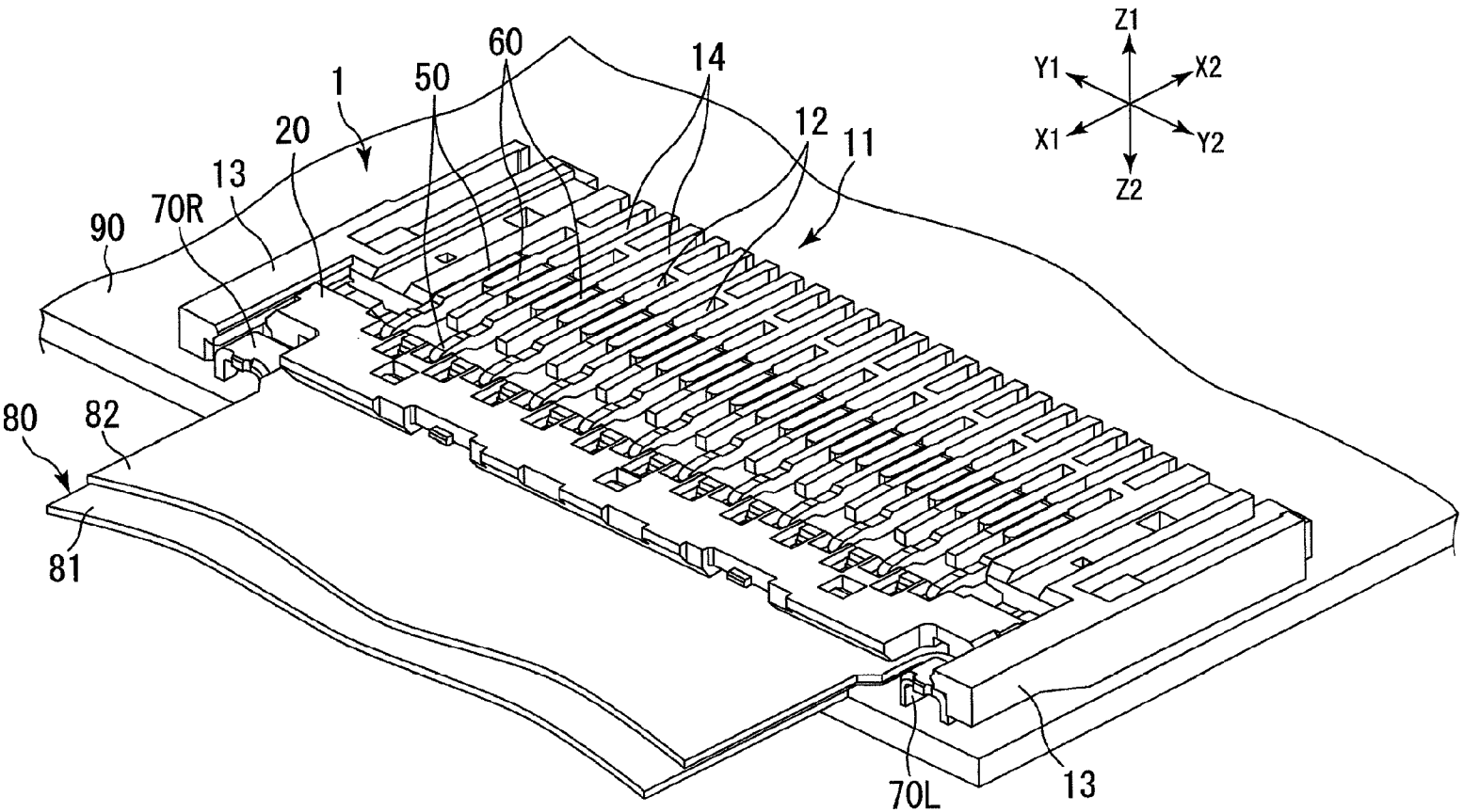
FIG. 1 is a perspective view of an electric connector of the present disclosure.
Figure 2:
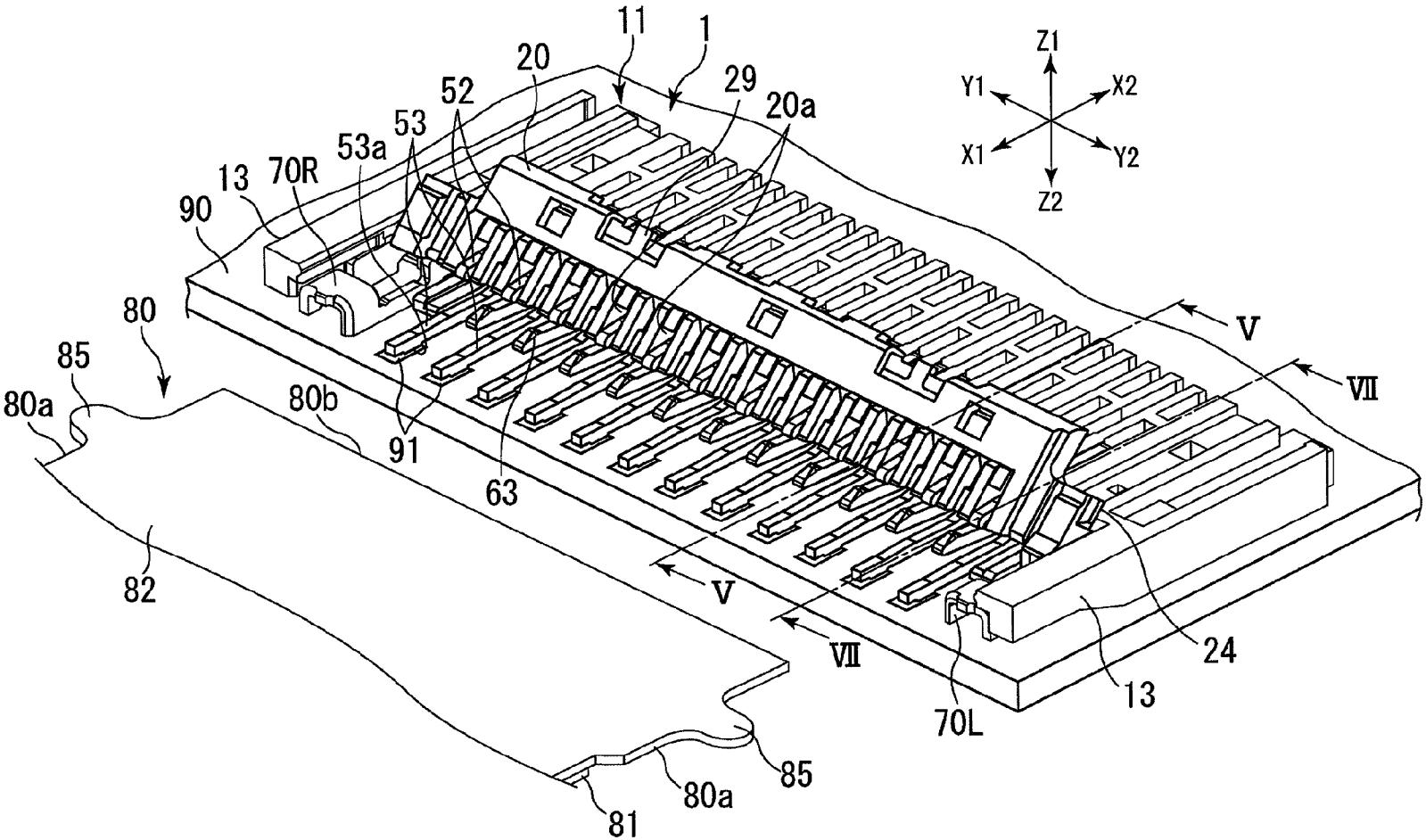
FIG. 2 is a perspective view of the electric connector with an actuator open.
Figure 3:
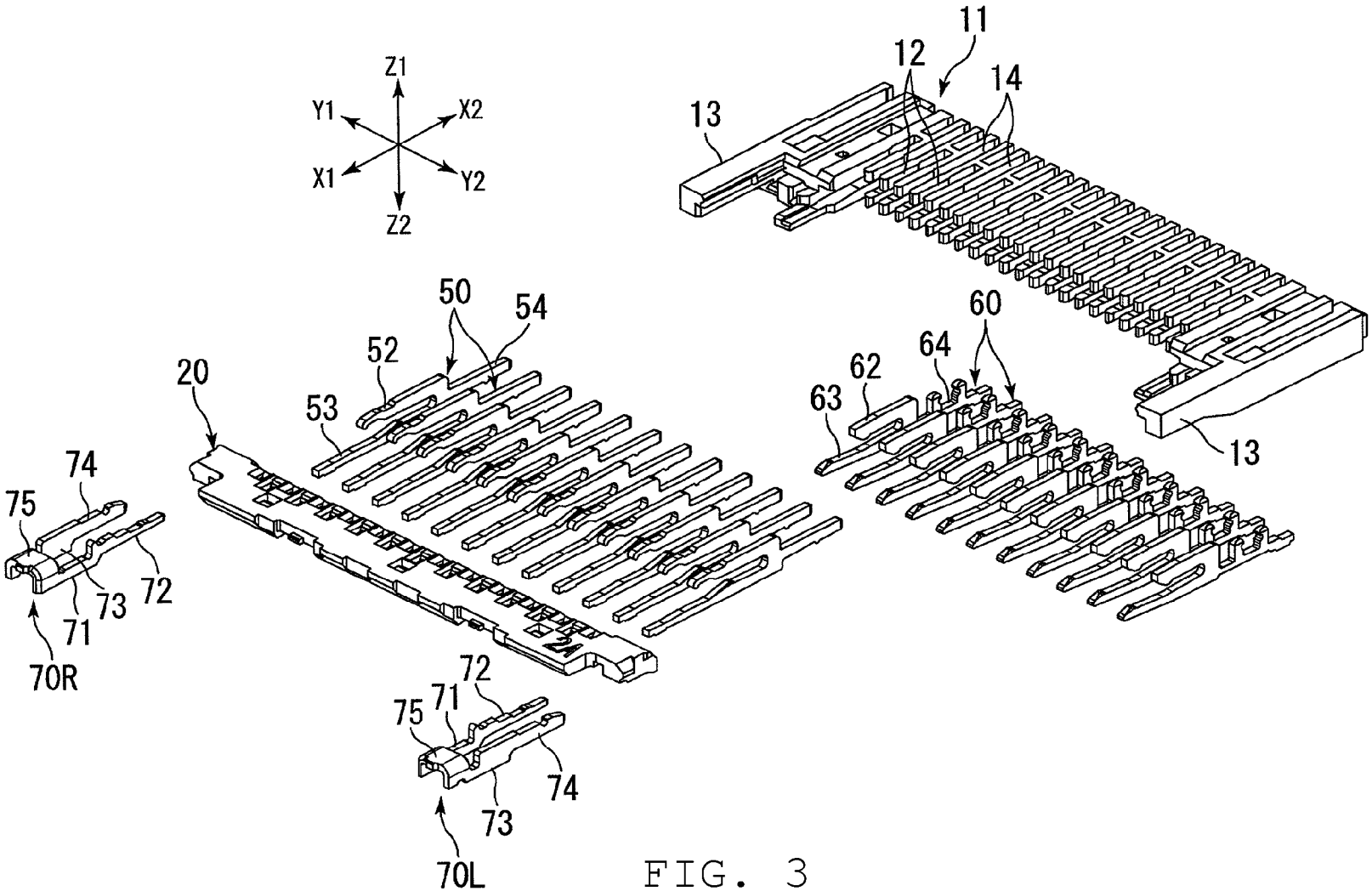
FIG. 3 is an exploded perspective view of the electric connector.
Figure 4:
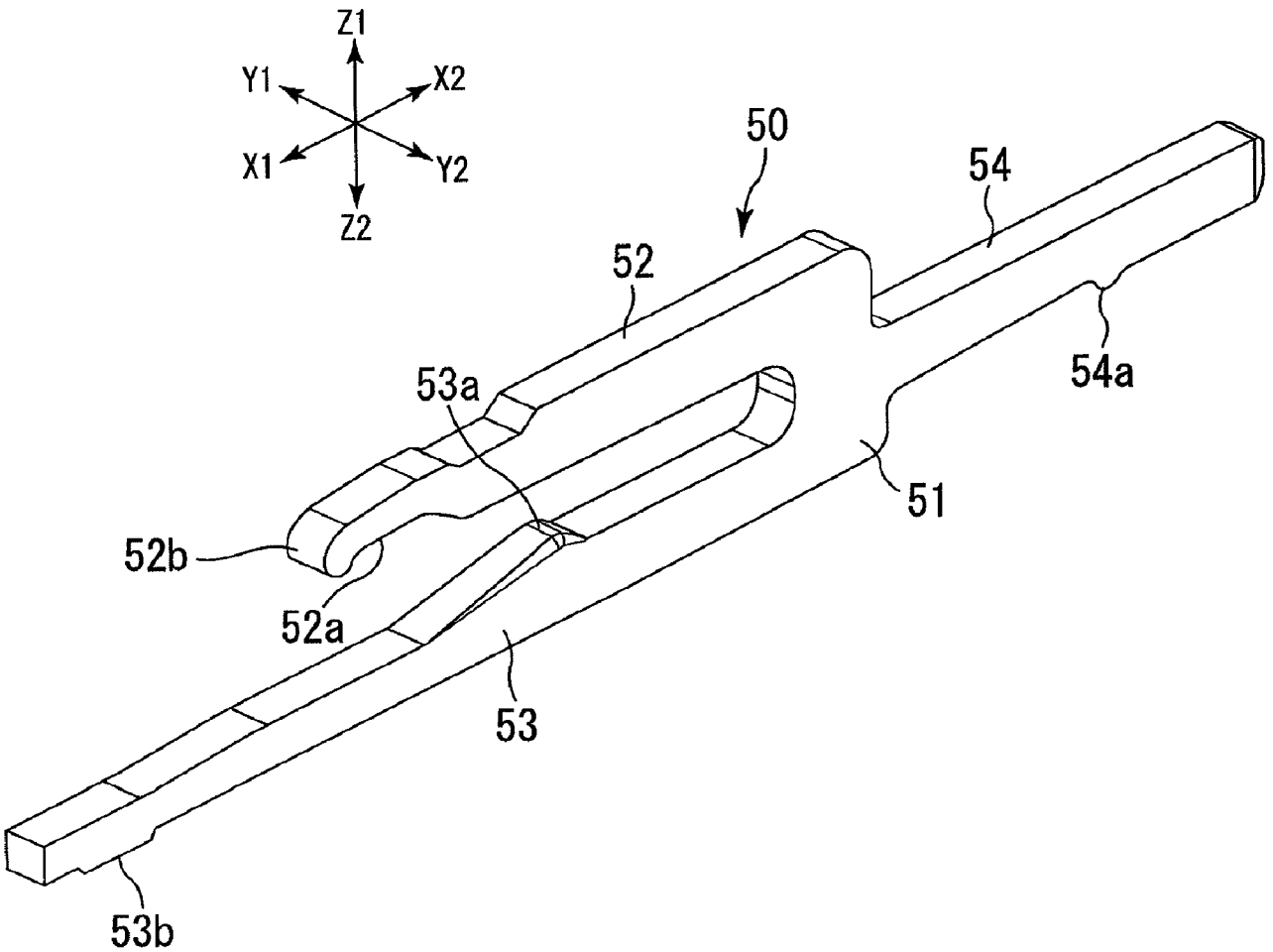
FIG. 4 is a perspective view of a front connection terminal of the electric connector.
Figure 5:
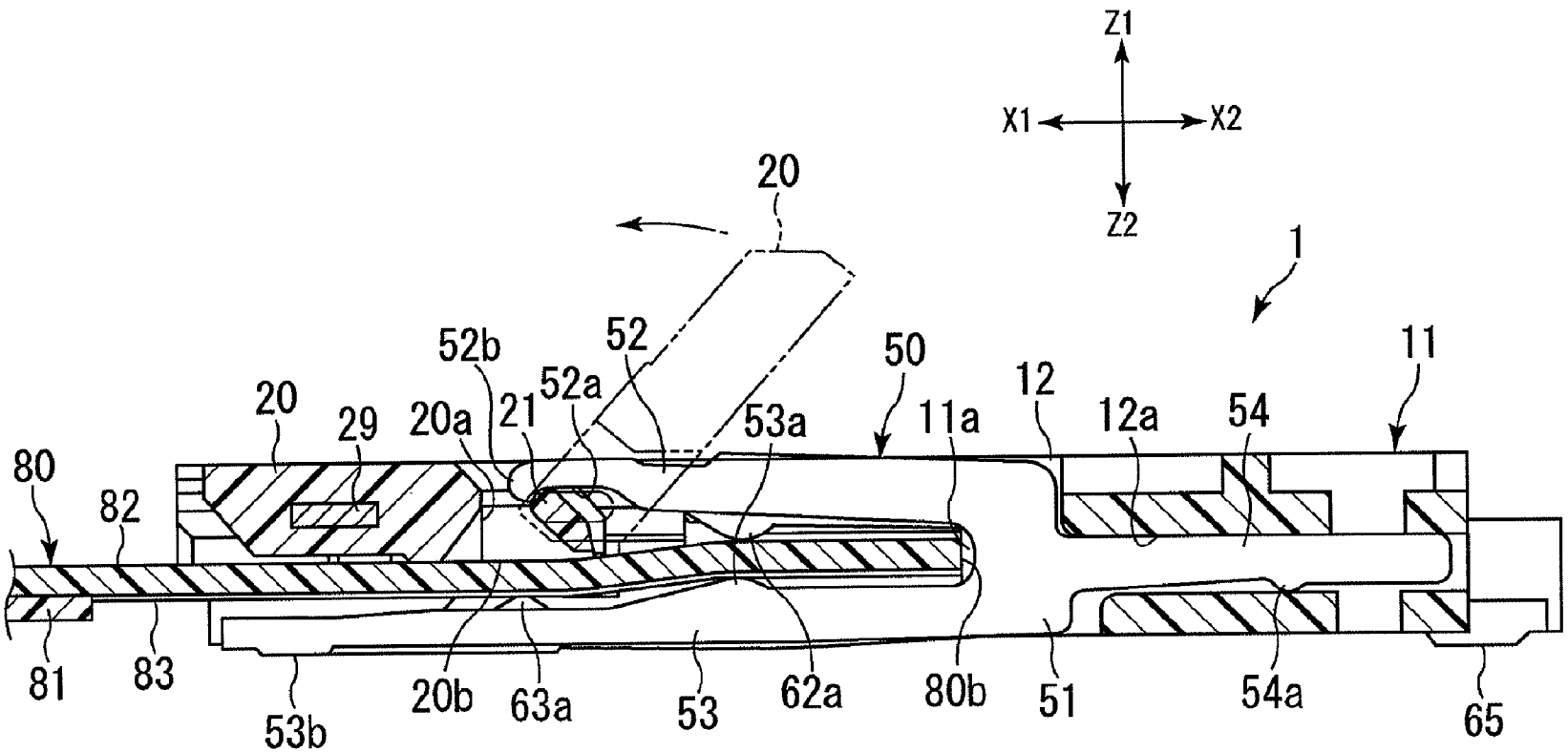
FIG. 5 is a cross sectional view along the Line V-V of FIG. 2, showing the front connection terminal mounted in a housing.
Figure 6:
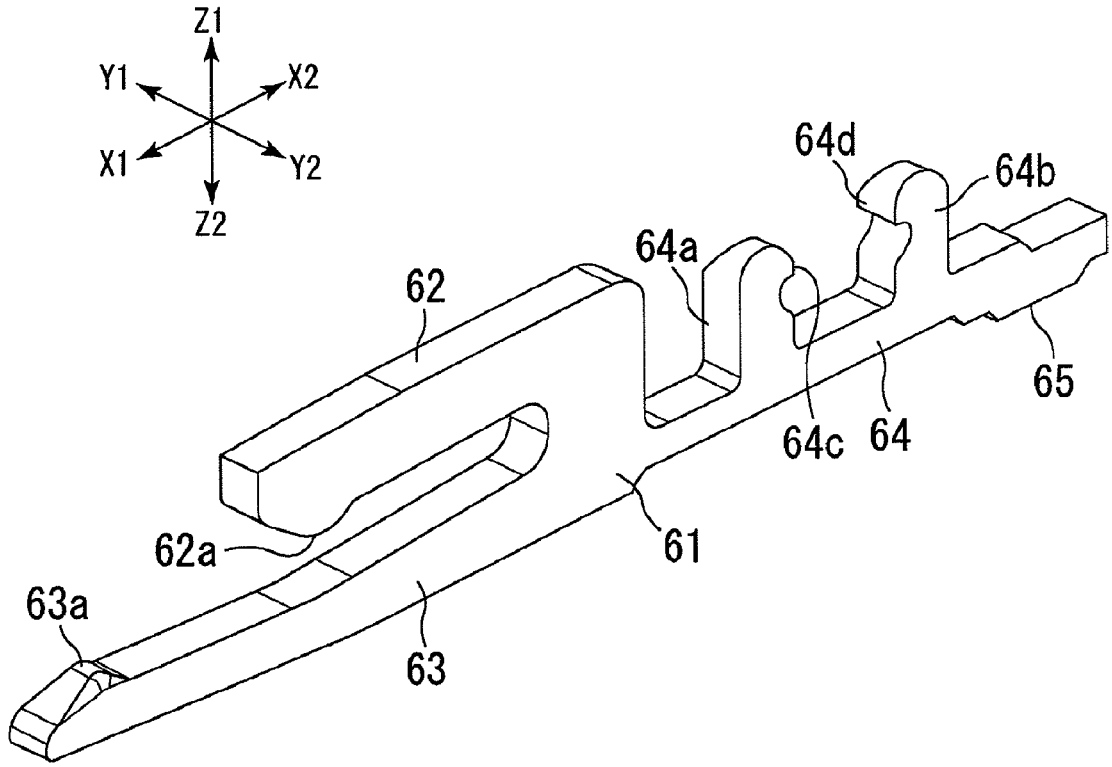
FIG. 6 is a perspective view of a rear connection terminal of the electric connector.
Figure 7:
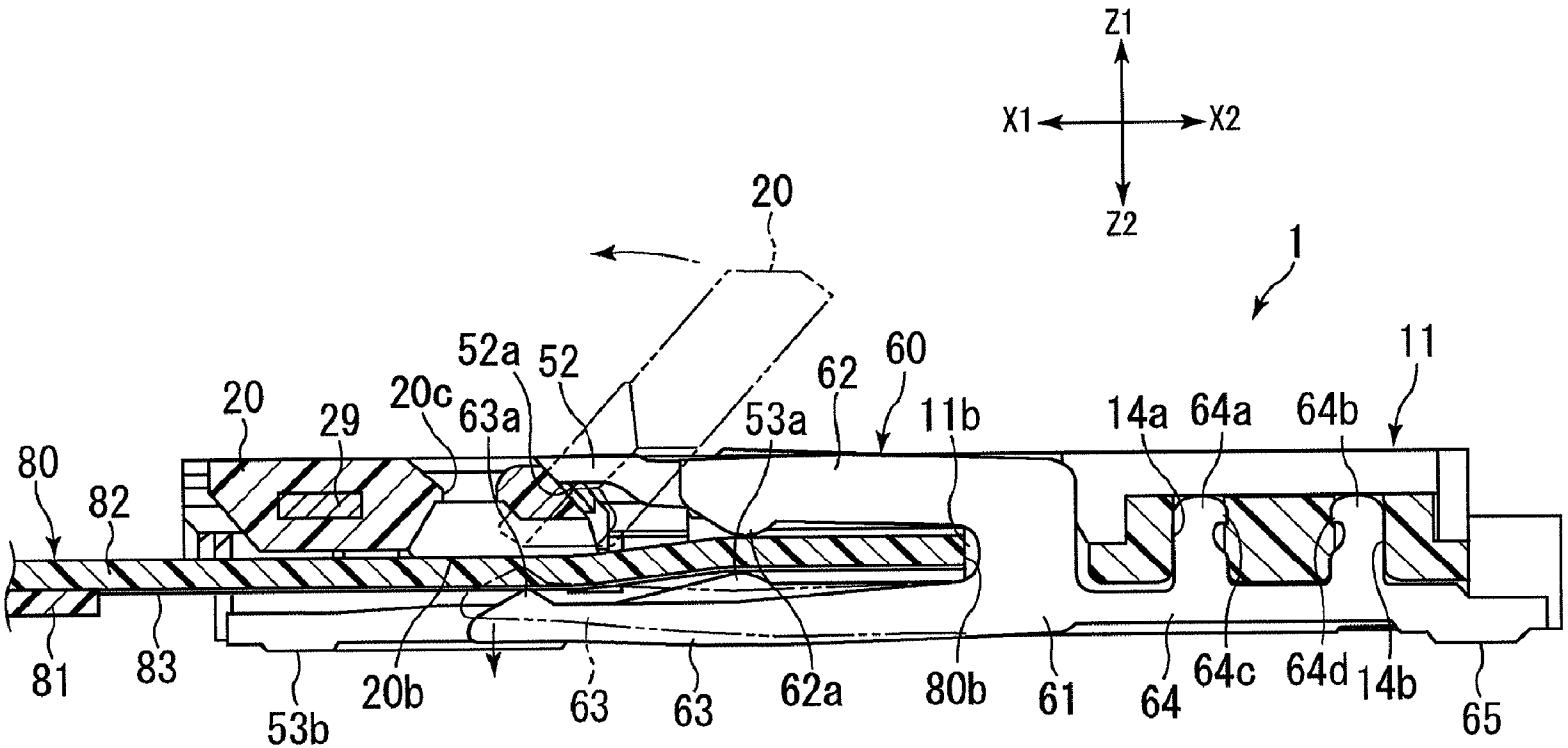
FIG. 7 is a cross sectional view along the Line VII-VII in FIG. 2, showing the rear connection terminal mounted in the housing.
Figure 8:
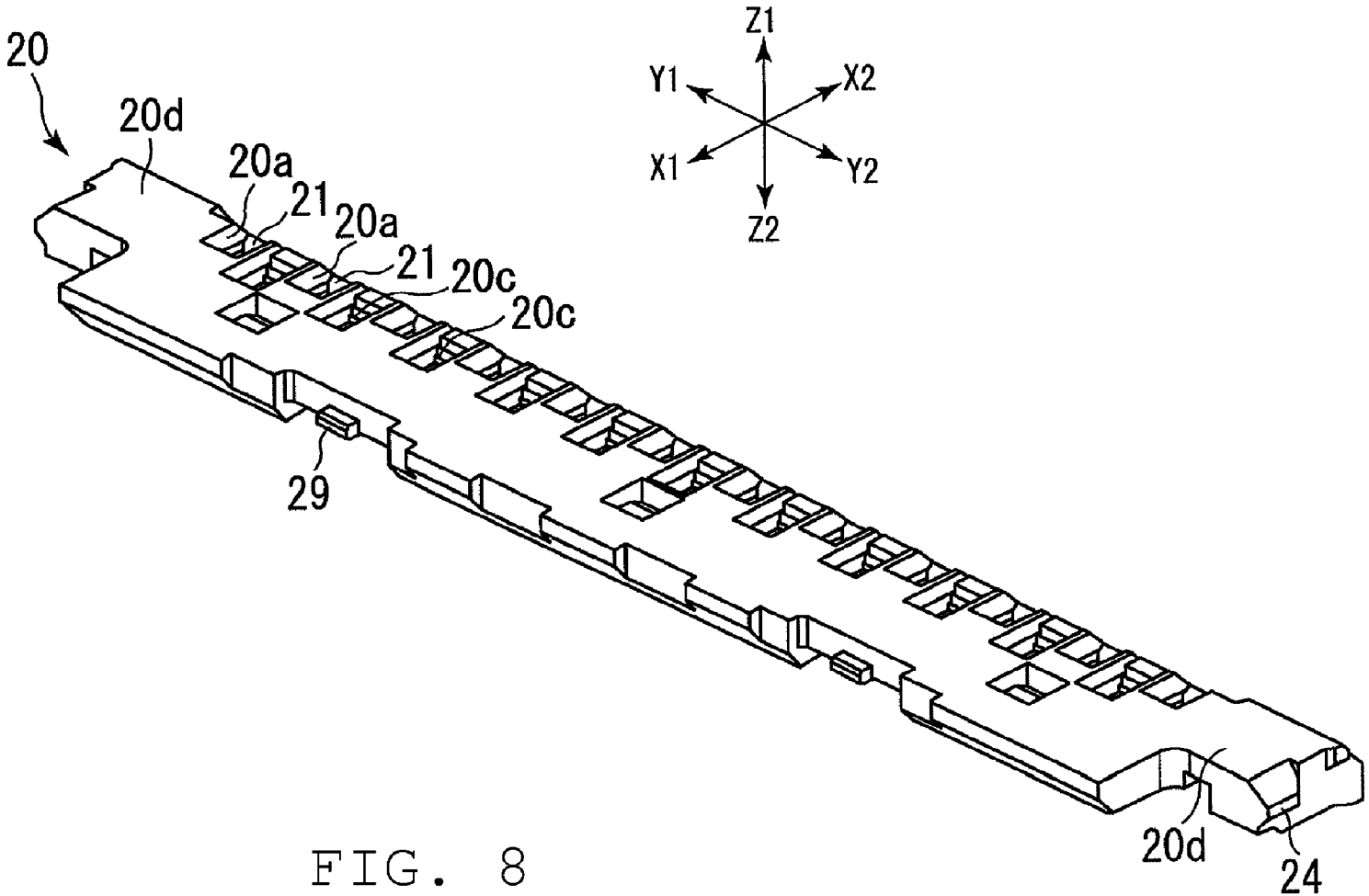
FIG. 8 is a perspective view of the actuator viewed diagonally from above.
Figure 9:
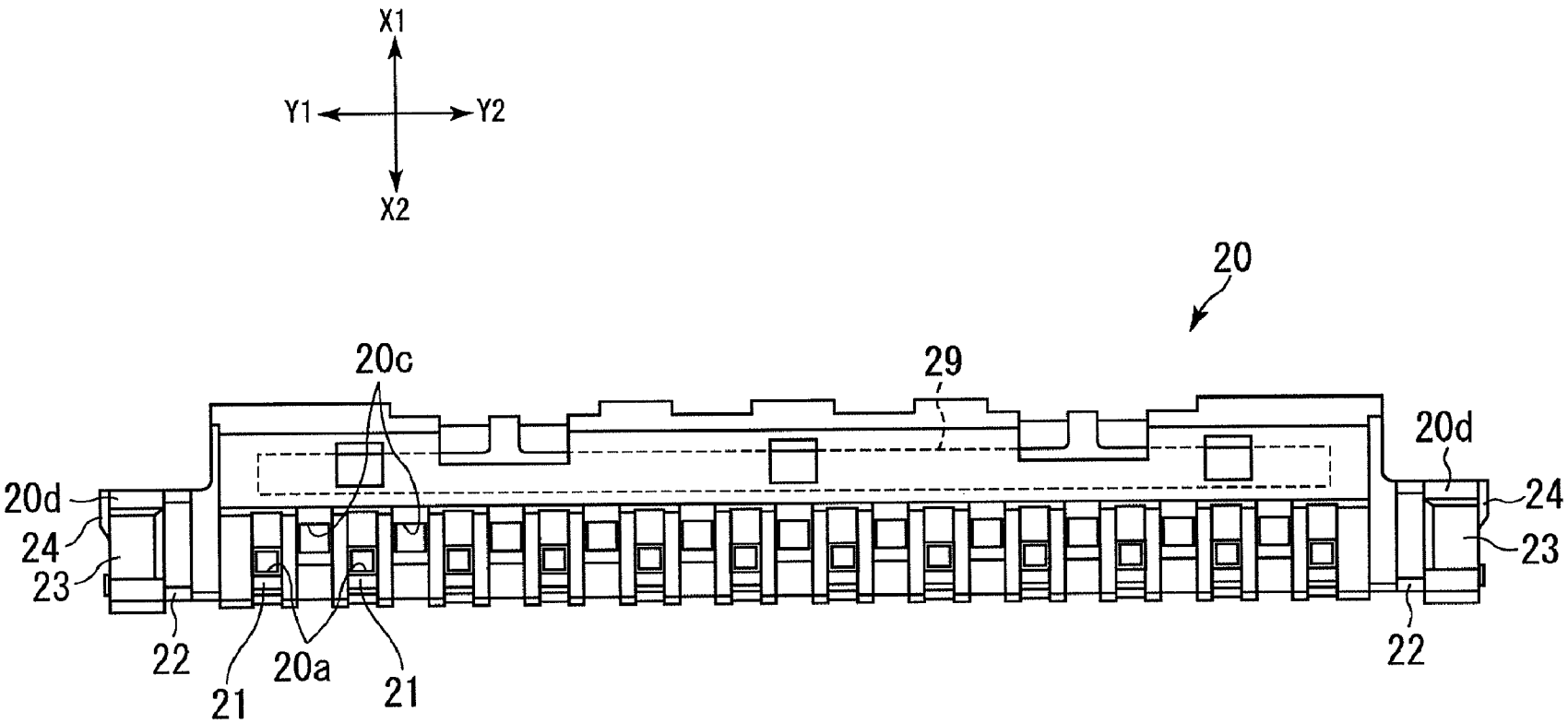
FIG. 9 is a bottom view of the actuator.

In the following, one embodiment of the present disclosure will be described with reference to the accompanying drawings. FIG. 1 is a perspective view of an electric connector 1 which is an example of an embodiment of the present disclosure; FIG. 2 is a perspective view of the electric connector 1 with an actuator 20 open; and FIG. 3 is an exploded perspective view of the electric connector 1. FIG. 4 is a perspective view of a front connection terminal 50 of the electric connector 1. FIG. 5 is a cross sectional view along the Line V-V in FIG. 2, showing the front connection terminal 50 fitted into the housing 11. FIG. 6 is a perspective view of a rear connection terminal 60 of the electric connector 1. FIG. 7 is a cross sectional view along the Line VII-VII in FIG. 2, showing the rear connection terminal 60 fitted into the housing 11. Further, FIG. 8 is a perspective view of the actuator 20 viewed diagonally from above; and FIG. 9 is a bottom view of the actuator 20. It should be noted that FIGS. 5 and 7 show the electric connector 1 with an FPC 80 inserted therein and the actuator 20 closed.

As shown in FIG. 1, the electric connector 1 is an electric connector for connecting an FPC 80 as a flat electric cable to a circuit board 90. The FPC 80 comprises a flexible circuit main part 81 and a reinforcing panel 82 which is more rigid than the circuit main part 81. The reinforcing panel 82 is attached on the upper surface of the edge part of the circuit main part 81. Also, on the edge part of the circuit main part 81, a plurality of conductors 83 are provided, extending in the insertion direction (backward, or in the X2 direction) of the FPC 80 (see FIGS. 5 and 7). In the edge part of the circuit main part 81, the conductor 83 is exposed downward.

As shown in FIGS. 1 to 3, the electric connector 1 comprises a plurality of front connection terminals 50 and a plurality of rear connection terminals 60, both for electrically connecting the FPC 80 and the circuit board 90, and a housing 11 for retaining the terminals 50, 60 as arrayed. Also, the electric connector 1 has an actuator 20 for pressing down the inserted FPC 80 to thereby increase the contact strength between the conductor 83 and the terminals 50, 60. The electric connector 1 has reinforcing members 70R, 70L which are brought to be soldered on the circuit board 90 and increase the fixing strength of the electric connector 1 on the circuit board 90. As shown in FIG. 2, the FPC 80 has panel-like projecting portions 85, 85 projecting from the right and left edges 80*a*, 80*a* thereof (hereinafter, referred to as "side edges"). The projecting portions 85, 85 are formed on the reinforcing panel 82. The reinforcing members 70R, 70L prevent the FPC 80 from being pulled off from the electric connector 1 by catching the projecting portions 85, 85. In the following, the respective members forming the electric connector 1 will be described.

As shown in FIG. 4 or FIG. 5, the front connection terminal 50 has an upper beam 52 extending forward (the X1 direction) from the upper portion of the base 51 and a lower beam 53 extending forward from the lower portion of the base 51. The upper beam 52 and the lower beam 53 are positioned apart from each other in the up-down direction, and the FPC 80 is inserted between the upper beam 52 and the lower beam 53. In detail, the end portion of the circuit main part 81 and the reinforcing panel 82 attached on the upper surface of the end portion are inserted between the upper beam 52 and the lower beam 53.

Midway along the lower beam 53, a contact portion 53*a* projecting upward (the Z1 direction) is formed. The contact portion 53*a* contacts the conductor 83 exposed downward in the end portion of the circuit main part 81. On the tip end of the lower beam 53, a connection portion 53*b* projecting downward (the Z2 direction) for contacting the surface of the circuit board 90 is formed. The connection portion 53*b* is brought to be soldered on a pad 91 formed on the surface of the circuit board 90 (see FIG. 2).

On the lower surface of the tip end 52*b* (an end portion in the X1 direction) side of the upper beam 52, a crook 52*a* for catching a cam 21 formed on the actuator 20 is formed. The actuator 20 turns with the cam 21 caught by the crook 52*a*, thereby pressing down the reinforcing panel 82. The actuator 20 will be described later in detail. In this connection, the lower beam 53 is longer than the upper beam 52, so that the connection portion 53*b* of the lower beam 53 is positioned anterior to the crook 52*a* of the upper beam 52. Also, the crook 52*a* is positioned anterior to the contact portion 53*a* of the lower beam 53.

As shown in FIGS. 6 and 7, the rear connection terminal 60 also has an upper beam 62 extending forward from the upper portion of the base 61 and a lower beam 63 extending forward from the lower portion of the base 61. The upper beam 62 and the lower beam 63 are positioned apart from each other in the up-down direction, and the FPC 80 is inserted between the upper beam 62 and the lower beam 63. In detail, the end portion of the circuit main part 81 and the reinforcing panel 82 attached on the upper surface of the end portion are inserted between the upper beam 62 and the lower beam 63. On the tip end of the lower beam 63, a contact portion 63*a* projecting upward is formed. The contact portion 63*a* contacts the conductor 83 of the FPC 80. On the tip end of the upper beam 62, a pressing portion 62*a* projecting downward is formed. When the actuator 20 turns, the pressing portion 62*a* presses down the FPC 80 inserted between the upper beam 62 and the lower beam 63.

In this connection, the lower beam 63 is longer than the upper beam 62, so that the contact portion 63*a* is positioned anterior to the pressing portion 62*a*. Also, the position of the contact portion 63*a* in the front-rear direction (the X1-X2 direction) substantially coincides with the position of the tip end 52*b* of the upper beam 52 in the front-rear direction (see FIG. 5). Further, the position of the pressing portion 62*a* in the front-rear direction substantially coincides with the position of the contact portion 53*a* in the front-rear direction (see FIG. 5 or FIG. 7).

Also, the rear connection terminal 60 has an extending portion 64 extending backward (the X2 direction) from the base 61. On the tip end of the extending portion 64, a connection portion 65 for contacting the surface of the circuit board 90 is formed. The connection portion 65 and the connection portion 53*b* of the front connection terminal 50 are positioned apart from each other in the front-rear direction. The connection portion 65 also is brought to be soldered on a pad (not shown) formed on the surface of the circuit board 90.

The plurality of front connection terminals 50 and the plurality of rear connection terminals 60 are retained by the housing 11 alternately arranged in the left-right direction (the Y1-Y2 direction, the width direction of the FPC 80). In detail, a plurality of retaining grooves 12 which are long in the front-rear direction (the X1-X2 direction) and a plurality of retaining grooves 14 similarly long in the front-rear direction are alternately formed in the housing 11 (see FIG. 1). As shown in FIG. 5, a hole 12*a* extending backward is formed on a deep portion of each retaining groove 12*a*. The front connection terminal 50 has a press-fitted portion 54 extending backward from the base 51 (see FIG. 4). The plurality of front connection terminals 50 are inserted into the respective retaining grooves 12 from the front of the housing 11, so that the press-fitted portions 54 are respectively pressed into the holes 12*a* of the housing 11. Midway along the press-fitted portion 54, a claw 54*a* is formed. The claw 54*a* is caught on the inner surface of the hole 12*a*, whereby the front connection terminal 50 is fixed in the housing 11.

Also, as shown in FIG. 7, vertically extending holes 14*a*, 14*b* are formed on a deep portion of each retaining groove 14. Press-fitted portions 64*a*, 64*b* projecting upward are formed on the extending portion 64 of the rear connection terminal 60. A plurality of rear connection terminals 60 are inserted into the respective retaining grooves 14 from below the housing 11 so that the press-fitted portions 64*a*, 64*b* are pressed into the holes 14*a*, 14*b* of the housing 11. On the tip ends of the press-fitted portions 64*a*, 64*b*, claws 64*c*, 64*d* are respectively formed. With the claws 64*c*, 64*d* caught on the inner surface of the respective holes 14*a*, 14*b*, the rear connection terminal 60 is fixed to the housing 11.

As shown in FIG. 8 or FIG. 9, the actuator 20 is a bar-like member long in the left-right direction, and positioned on the tip end (the end portion in the X1 direction) side of the upper beams 52, 62 and above the lower beams 53, 63. Insertion holes 20*a* are formed at the positions corresponding to the upper beams 52. As shown in FIG. 2 or FIG. 5, the tip end 52*b* of the upper beam 52 is fitted into the insertion hole 20*a*, and the cam 21 formed on the edge of the insertion hole 20*a* is caught by the crook 52*a* formed on the tip end 52*b* side of the upper beam 52. The actuator 20 can turn, using the cam 21 as a fulcrum, between an open position with the actuator 20 standing upward above the upper beam 52 (the position with the actuator 20 depicted by the long dashed double-short dashed line in FIGS. 5 and 7), and a closed position with the actuator 20 lying towards the lower beam 53 side (the position with the actuator 20 depicted by the solid line in FIGS. 5 and 7). The cam 21 becomes substantially parallel to the upper beam 52 when the actuator 20 is in the open position, and the cam 21 becomes substantially perpendicular to the upper beam 52 when the actuator 20 is in the closed position. Then, with the actuator 20 in the closed position, the cam 21 receives a downward force from the upper beam 52.

The actuator 20 turns from the open position to the closed position with the cam 21 caught by the crook 52*a*. Accordingly, the actuator 20 presses down the FPC 80 inserted into the front connection terminals 50 and rear connection terminals 60, whereby the contact strength between the contact portions 53*a*, 63*a* and the conductor 83 is increased.

In the example described here, the actuator 20, when placed in the closed position and thus receiving a downward force from the upper beam 52, presses the conductor 83 of the FPC 80 toward the contact portion 63*a* positioned between two adjacent lower beams 53. Also, accordingly, the pressing portion 62*a* of the rear connection terminal 60 presses the conductor 83 toward the contact portion 53*a* positioned between two adjacent lower beams 63. That is, as shown in FIG. 5, with the actuator 20 having been turned to the closed position, the upper beam 52 presses down the cam 21, and the lower surface 20*b* of the actuator 20 presses down the FPC 80. As described above, the position of the tip end 52*b* of the front connection terminal 50 in the front-rear direction (the X1-X2 direction) substantially coincides with the position of the contact portion 63*a* of the rear connection terminal 60 in the front-rear direction. Therefore, as the crook 52*a* on the tip end 52*b* side presses down the cam 21, the lower surface 20*b* of the actuator 20 presses the FPC 80 onto the contact portion 63*a* of the rear connection terminal 60. Also, the lower beam 63 becomes bent downward when the FPC 80 applies a downward force to the contact portion 63*a* (see FIG. 7). Then, as shown in FIG. 7, the pressing portion 62*a* formed on the tip end of the upper beam 62, presses down a portion of the FPC 8, posterior to the actuator 20. As described above, the position of the pressing portion 62*a* in the front-rear direction substantially coincides with the position of the contact portion 53*a* of the front connection terminal 50 in the front-rear direction. Therefore, as the pressing portion 62*a* presses down the FPC 80, the conductor 83 formed on the lower surface of the FPC 80 is pressed onto the contact portion 53*a*. In this connection, in FIG. 7, the lower beam 63 before being pressed down by the lower surface 20*b* is depicted by the long dashed double-short dashed line.

As shown in FIG. 8, the actuator 20 additionally has a plurality of holes 20*c* arranged alternately with respect to the plurality of insertion holes 20*a*. The position of the hole 20*c* corresponds to the position of the upper beam 62. When the actuator 20 is in the open position, the tip end of the upper beam 62 is fitted into the hole 20*c*, which allows the actuator 20 to largely turn toward the open position side.

Figure 10:
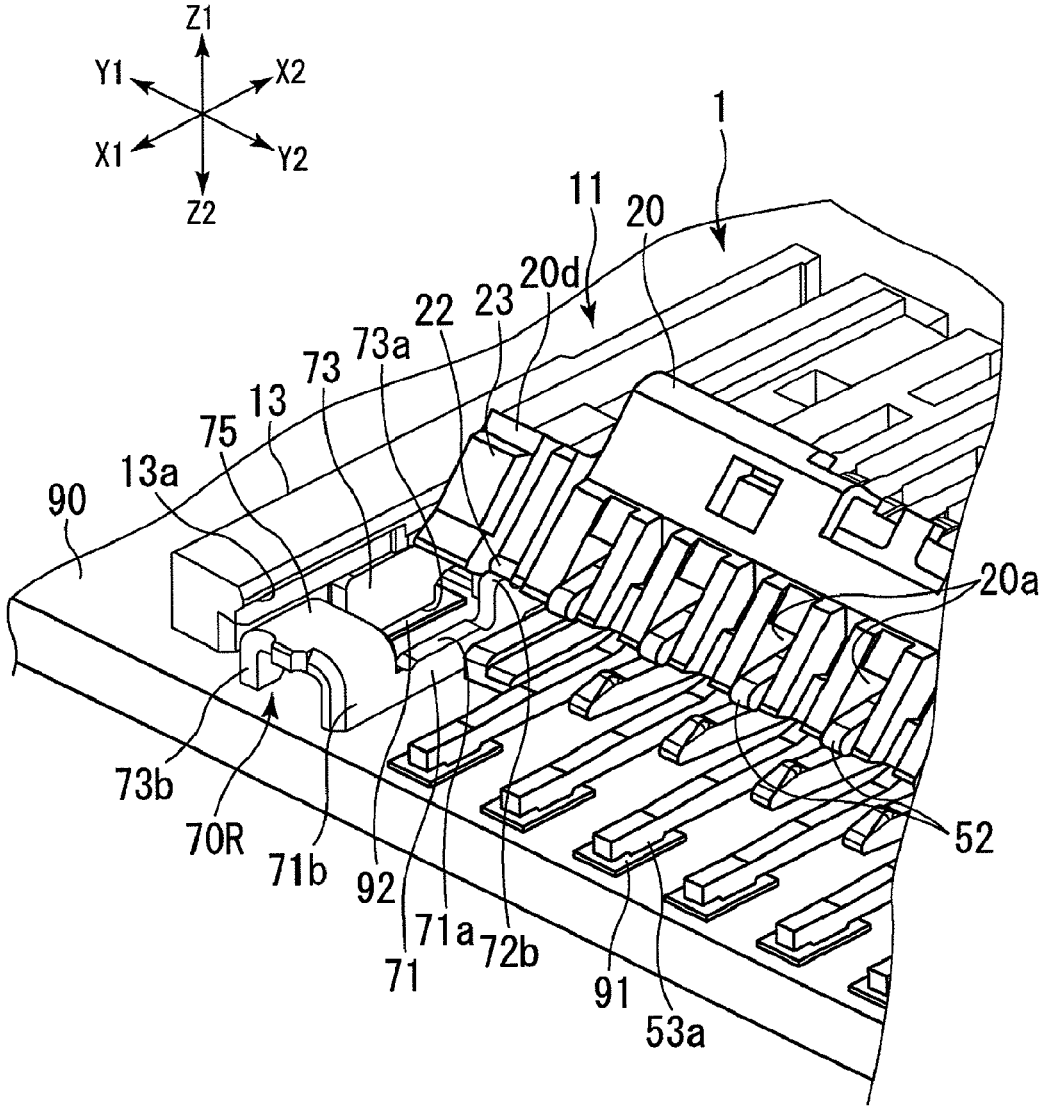
FIG. 10 is an enlarged perspective view of the electric connector, mainly showing a portion where the reinforcing member is provided.

The actuator 20 is molded using resin, and has a core member 29 provided inside for reinforcing the actuator 20 (see FIG. 10). The core member 29 is held inside the actuator 20 by means of insert molding.

The reinforcing members 70R, 70L will now be described. As shown in FIG. 2, the reinforcing members 70R, 70L are placed outside (the right side (the Y1 direction side) and the left side (the Y2 direction side)) in the width direction of the FPC 80 relative to the front connection terminals 50 and rear connection terminals 60. When the FPC 80 is inserted into the front connection terminals 50 and rear connection terminals 60, the reinforcing members 70R, 70L are resultantly positioned adjacent to the left and right edges 80*a*, 80*a* of the FPC 80, respectively. Also, the housing 11 has frame portions 13, 13 extending forward, and the reinforcing members 70R, 70L are positioned inside relative to the respective frame portions 13, 13. As the shapes and positions of the reinforcing members 70R and reinforcing member 70L are symmetrical, the reinforcing member 70R will be mainly described here.

Figure 11:
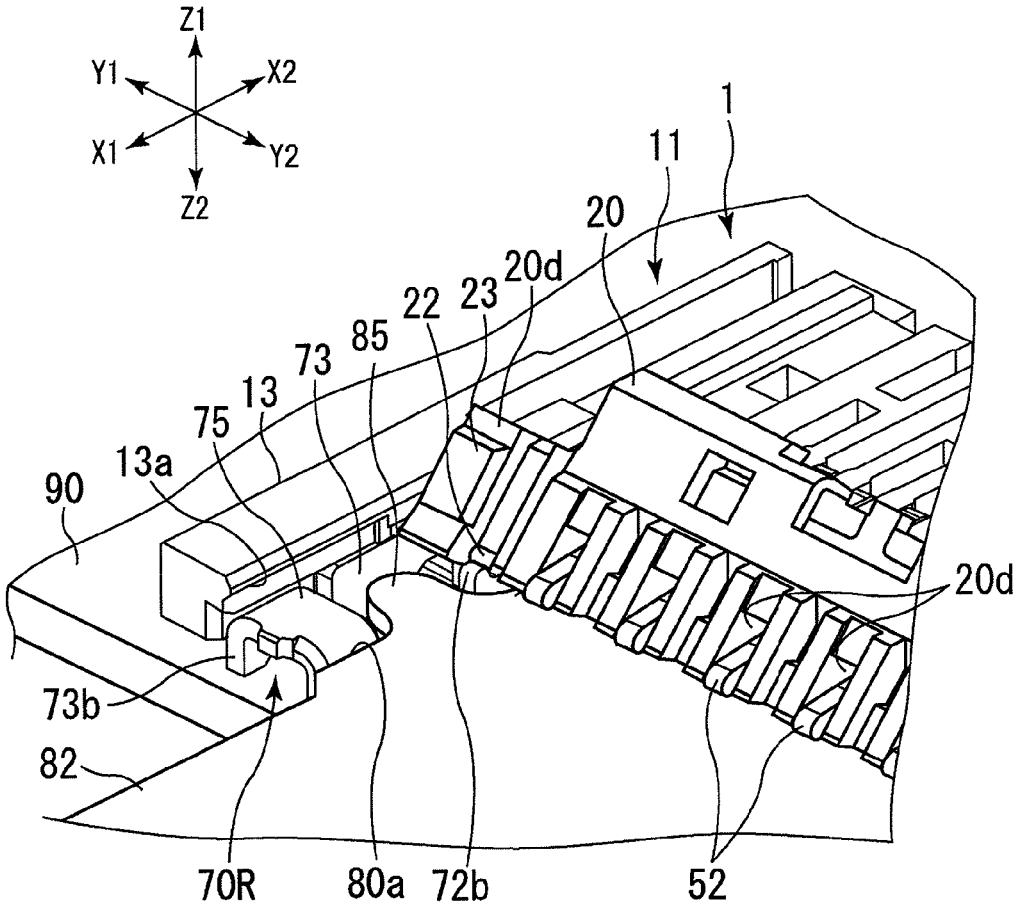
FIG. 11 is an enlarged perspective view of the electric connector with an FPC inserted therein.
Figure 12:
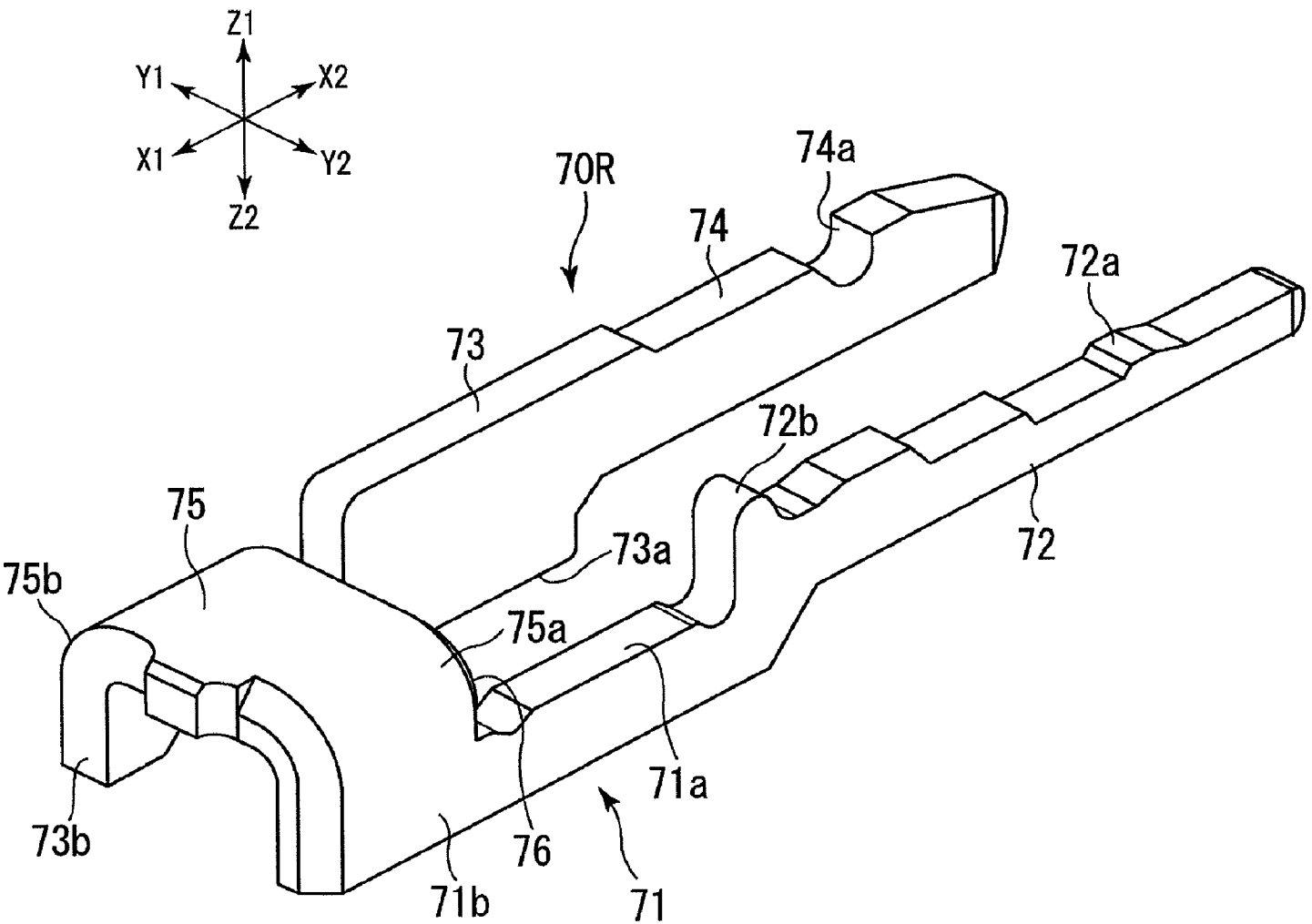
FIG. 12 is a perspective view of a reinforcing member.
Figure 13:
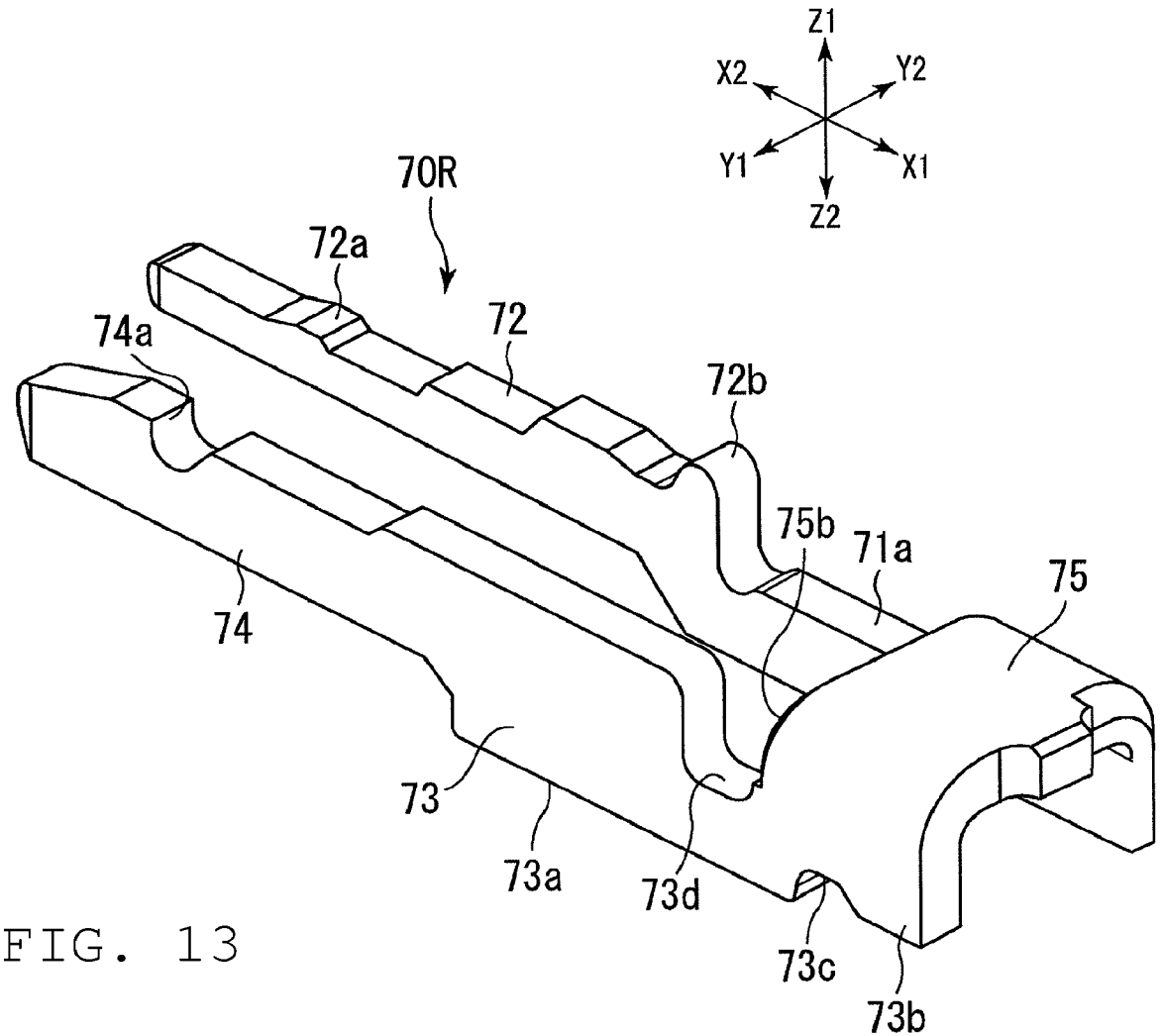
FIG. 13 is a perspective view of the reinforcing member viewed from a direction different from that in FIG. 12.
Figure 14:
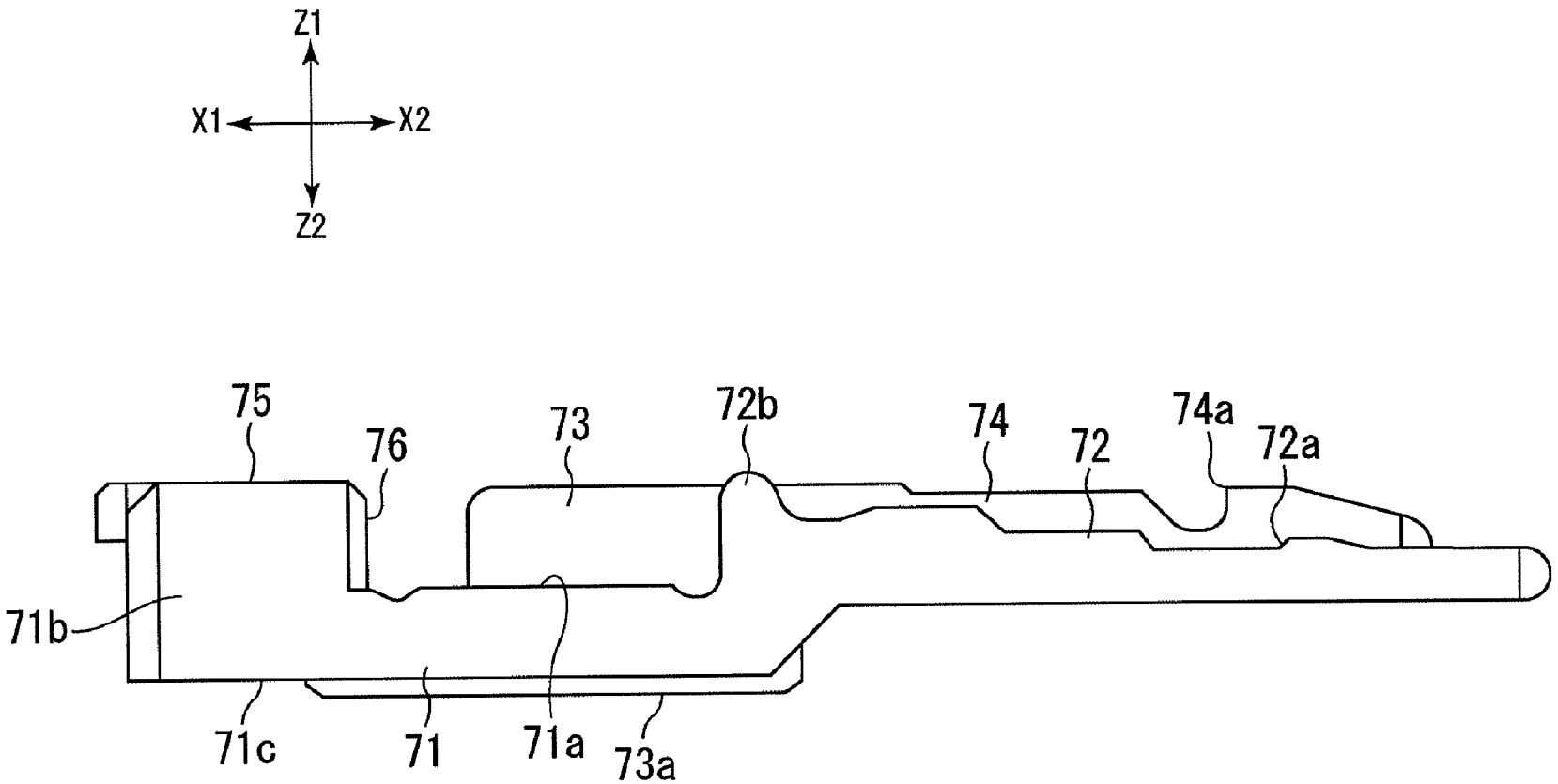
FIG. 14 is a side view of the reinforcing member.
Figure 15:
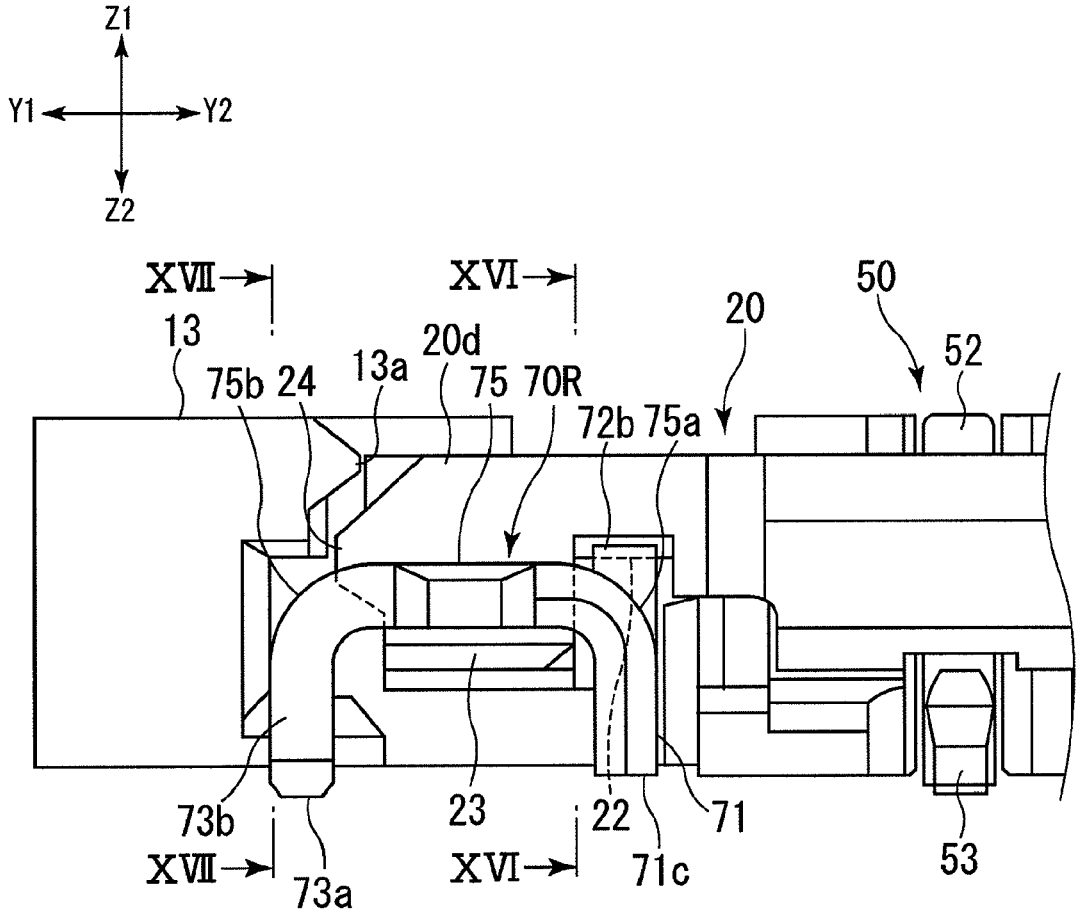
FIG. 15 is a front view of the electric connector, mainly showing a portion where the reinforcing member is provided.
Figure 16:
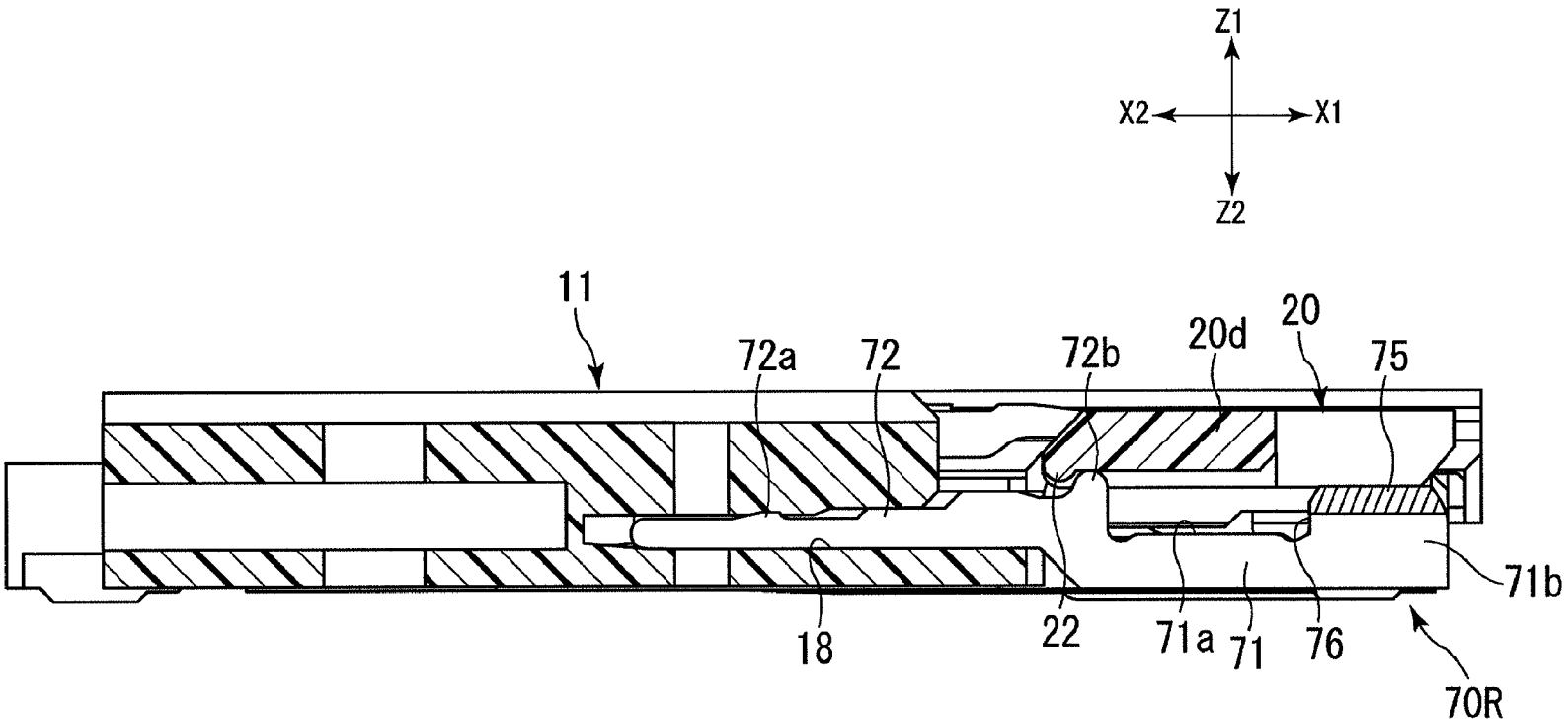
FIG. 16 is a cross sectional view along the Line XVI-XVI shown in FIG. 15.
Figure 17:
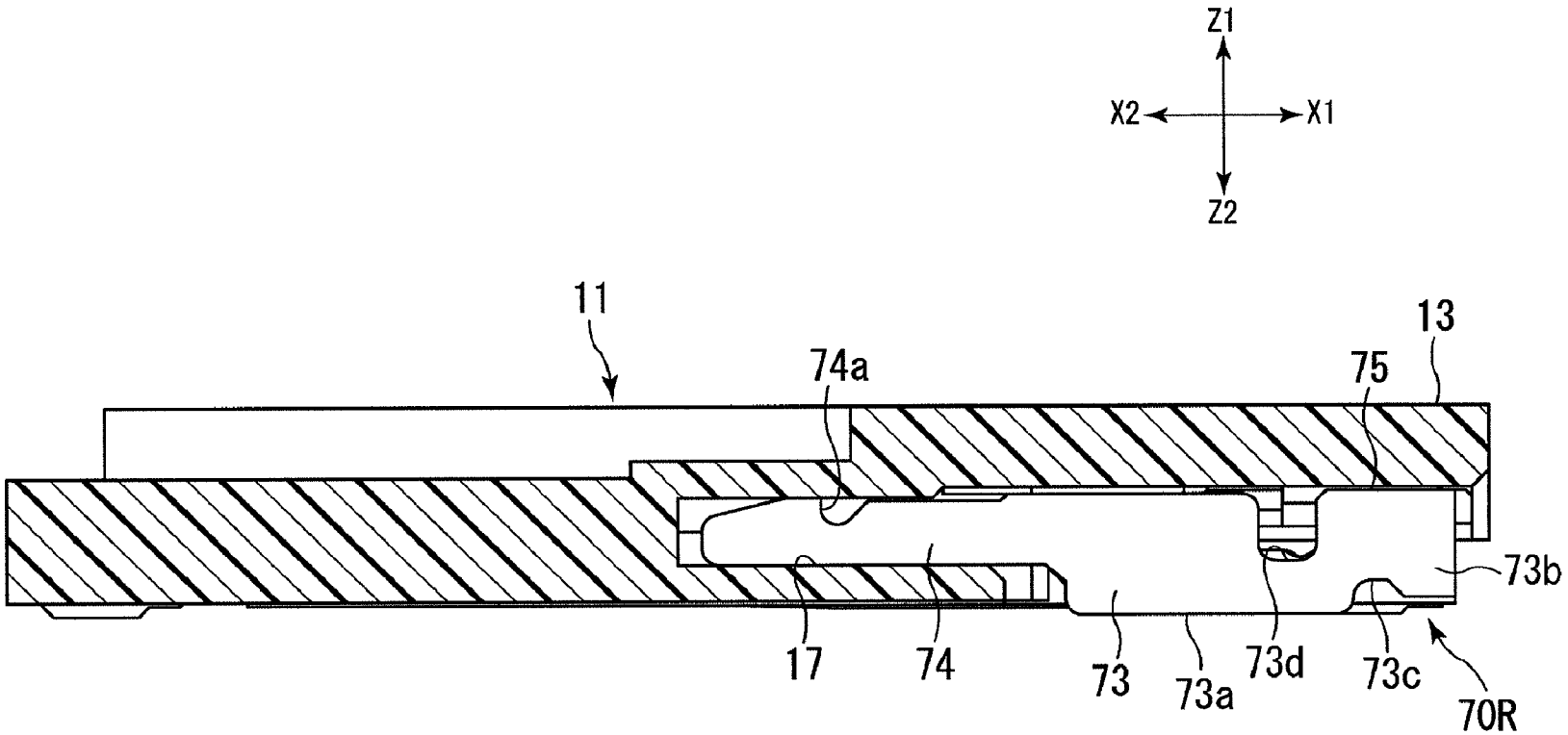
FIG. 17 is a cross sectional view along the Line XVII-XVII shown in FIG. 15.

FIG. 10 is an enlarged perspective view of the electric connector 1, mainly showing a portion thereof where the reinforcing member 70R is provided; FIG. 11 is an enlarged perspective view of the electric connector 1 with the FPC 80 inserted therein. FIG. 12 is a perspective view of the reinforcing member 70R; FIG. 13 is a perspective view of the reinforcing member 70R viewed from a direction different from that in FIG. 12; and FIG. 14 is a side view of the reinforcing member 70R. FIG. 15 is a front view of the electric connector 1, mainly showing a portion thereof where the reinforcing member 70R is positioned; and FIG. 16 is a cross sectional view along the line XVI-XVI in FIG. 15; and FIG. 17 is a cross sectional view along the line XVII-XVII in FIG. 15.

As shown in FIGS. 10 to 13, the reinforcing member 70R comprises a pull-out stop portion 71, a fixed portion 73 positioned apart from the pull-out stop portion 71 in the left-right direction (the Y1-Y2 direction), and a connecting portion 75 extending rightward (in the Y1 direction) from the pull-out stop portion 71 and connecting to the fixed portion 73. The connecting portion 75 is put across the upper front portion (on the X1 direction side) of the pull-out stop portion 71 and the upper front portion of the fixed portion 73. The pull-out stop portion 71 is formed such that the projecting portion 85 can be placed thereon when the FPC 80 is inserted into the electric connector 1. In addition, a stopper portion 76 for catching the projecting portion 85 on the pull-out stop portion 71 is formed on the pull-out stop portion 71. In the following, the respective portions of the reinforcing member 70R will be described in detail.

The fixed portion 73 has a panel-like shape long in the front-rear direction and is formed so as to be substantially perpendicular to the circuit board 90 when the electric connector 1 is placed on the circuit board 90. A connection portion 73*a* is formed on the lower edge of the fixed portion 73. The connection portion 73*a* is positioned at the front portion (on the X1 direction side) of the fixed portion 73. When the electric connector 1 is placed on the circuit board 90, the connection portion 73*a* contacts the pad 92 formed on the surface of the circuit board 90 (see FIG. 10). The connection portion 73*a* is brought to be soldered to the pad 92.

As the lower edge of the front end portion 73*b* of the fixed portion 73 is positioned higher than the connection portion 73*a*, a gap is secured between the lower edge of the end portion 73*b* of the fixed portion 73 and the surface of the circuit board 90 when the electric connector 1 is placed on the circuit board 90. Also, as shown in FIG. 13, a recess 73*c* is formed on the lower edge of the fixed portion 73. The recess 73*c* is positioned between the end portion 73*b* and connection portion 73*a* of the fixed portion 73. With this structure, solder to be supplied to the connection portion 73*a* when fixing the connection portion 73*a* on the pad 92 is prevented from reaching the end portion 73*b*. In this regard, the connecting portion 75 is continuous to the upper edge on the end portion 73*b* side.

The fixed portion 73 has a fixed portion side press-fitted portion 74 extending backward. As shown in FIG. 17, a fitting hole 17 long in the front-rear direction is formed at a position in the housing 11, opposed to the fixed portion side press-fitted portion 74. The fixed portion side press-fitted portion 74 is pressed into the fitting hole 17. On the tip end side of the fixed portion side press-fitted portion 74, a claw 74*a* caught on the inner surface of the fitting hole 17 is formed.

The pull-out stop portion 71 has a pull-out stop portion side press-fitted portion 72 extending backward. As shown in FIG. 16, a fitting hole 18 long in the front-rear direction is formed at a position in the housing 11, opposed to the pull-out stop portion side press-fitted portion 72, and the pull-out stop portion side press-fitted portion 72 is pressed into the fitting hole 18. Midway along the pull-out stop portion side press-fitted portion 72, a claw 72*a* caught on the inner surface of the fitting hole 18 is formed. With the pull-out stop portion side press-fitted portion 72 and fixed portion side press-fitted portion 74 are pressed into the respective fitting holes 18, 17, the reinforcing member 70R is fixed in the housing 11. In this regard, the fitting hole 17 has a size substantially identical to that of the up-down width of the fixed portion side press-fitted portion 74. Meanwhile, the fitting hole 18 has a size slightly smaller than the up-down width of the pull-out stop portion side press-fitted portion 72. With this structure, the pull-out stop portion side press-fitted portion 72 is more rigidly fixed in the housing 11 than the fixed portion side press-fitted portion 74.

On the base of the pull-out stop portion side press-fitted portion 72, a projecting portion 72*b* projecting upward is formed. Meanwhile, at a position of the actuator 20, corresponding to the projecting portion 72*b*, that is, on the edge of the end portion 20*d* side in the left-right direction of the actuator 20, a convex portion 22 is formed (see FIG. 10). The reinforcing member 70R is pressed into the housing 11 from the front side (the X1 direction side) of the housing 11 after the actuator 20 is mounted on the upper beam 52 of the front connection terminal 50. As a result, as shown in FIG. 16, the projecting portion 72*b* is positioned ahead (the X1 direction) of the convex portion 22 of the actuator 20, so that the convex portion 22 is restricted from moving forward (the X1 direction). With this structure, separation of the actuator 20 from the housing 11 can be prevented by the reinforcing member 70R.

As shown in FIG. 10 or FIG. 12, the pull-out stop portion 71 has a panel-like shape long in the front-rear direction, and is formed so as to be perpendicular to the circuit board 90 when the electric connector 1 is placed on the circuit board 90. Also, the pull-out stop portion 71 is positioned adjacent to the edge 80*a* of an FPC 80 when the FPC 80 is inserted. The pull-out stop portion 71 has a placement edge 71*a* formed on a part of the upper edge thereof, and the projecting portion 85 can be placed on the placement edge 71*a*. The placement edge 71*a* is formed substantially parallel to the circuit board 90, and has a width (the length in the front-rear direction) corresponding to the width of the projecting portion 85. A stopper portion 76 is formed in the end portion ahead of the placement edge 71*a*. In the example described here, the pull-out stop portion 71 has a pull-out stop wall portion 71*b* formed ahead of the placement edge 71*a*, and the pull-out stop wall portion 71*b* is higher than the placement edge 71*a*, so that the edge of the pull-out stop wall portion 71*b* forms the stopper portion 76. When the FPC 80 is inserted into the front connection terminals 50 and rear connection terminals 60, the projecting portion 85 is placed on the placement edge 71*a* (see FIG. 11). Then, when the FPC 80 is pulled forward (the X1 direction), the projecting portion 85 is caught on the stopper portion 76, whereby the FPC 80 is prevented from being pulled off. In this regard, the placement edge 71*a*, stopper portion 76, and projecting portion 72*b* together form a recess where the projecting portion 85 is retained (see FIG. 14).

The position of the placement edge 71*a* in the pull-out stop portion 71 coincides with the position of the projecting portion 85 when the reinforcing panel 82 is inserted into an appropriate position relative to the electric connector 1. In the example described here, as shown in FIGS. 5 and 7, wall portions 11*a*, 11*b* are formed in deep portions of the housing 11, and the FPC 80 can be inserted until the tip end edge 80*b* of the FPC 80 abuts against the wall portions 11*a*, 11*b*. At the position where the projecting portion 85 is located when the FPC 80 is inserted until the tip end edge 80*b* abuts against the wall portions 11*a*, 11*b*, the placement edge 71*a* is formed. Also, as described above, the width of the placement edge 71*a* in the front-rear direction corresponds to the width of the projecting portion 85 in the front-rear direction. Therefore, whether or not the FPC 80 has been inserted into an appropriate position can be determined when inserting the FPC 80 into the front connection terminals 50 and rear connection terminals 60, depending on whether or not the projecting portion 85 is positioned on the placement edge 71*a*.

As shown in FIG. 10, a convex portion 23 is formed on the lower surface of the end portion 20*d* in the left-right direction of the actuator 20. The convex portion 23 is positioned between the fixed portion 73 and the pull-out stop portion 71 when the actuator 20 is positioned at the closed position (see FIG. 15), and the convex portion 23 abuts on, from above, the projecting portion 85 on the placement edge 71*a*. With this structure, the FPC 80 can be more reliably prevented from being pulled off from the electric connector 1.

Convex portions 24, 24 projecting in the left-right direction are formed on the end portions of the actuator 20 (see FIG. 2, FIG. 9, or FIG. 15). With the actuator 20 positioned in the closed position, the convex portion 24 moves downward, running on and crossing the edge 13*a* of the frame portion 13 formed on the housing 11 (see FIG. 15). With this structure, the actuator 20 is restricted from returning to the open position.

As shown in FIG. 14 or FIG. 15, the lower edge 71*c* of the pull-out stop portion 71 is positioned higher than the connection portion 73*a* of the fixed portion 73. That is, with the electric connector 1 placed on the circuit board 90, the connection portion 73*a* alone contacts the surface of the circuit board 90, retaining a space between the lower edge 71*c* and the surface of the circuit board 90.

As shown in FIG. 12 or FIG. 13, the connecting portion 75 has a panel-like shape placed substantially parallel to the circuit board 90, extending rightward from the upper edge of the rear portion of the pull-out stop portion 71 and continuous to the upper edge of the fixed portion 73. Also, the position of the connecting portion 75 in the insertion direction of the FPC 80 is anterior to the placement edge 71*a*. That is, the connecting portion 75 is positioned anterior to the placement edge 71*a*. Therefore, when the FPC 80 is not positioned at an appropriate position, the projecting portion 85 is positioned on the connecting portion 75. As a result, whether or not the FPC 80 is positioned in an appropriate position can be determined depending on whether or not the projecting portion 85 is positioned on the connecting portion 75.

The connecting portion 75 is disposed substantially perpendicular to the pull-out stop portion 71, and the corner portion 75*a* where the connecting portion 75 is connected to the pull-out stop portion 71 is curved. With this structure, when inserting the FPC 80 into the electric connector 1, in the state in which the position of the FPC 80 is displaced in the left-right direction and the edge 80*a* of the FPC 80 is placed slightly on the connecting portion 75, the corner portion 75*a* guides the FPC 80 toward the center in the left-right direction.

In this regard, the corner portion 75*b* where the connecting portion 75 is connected to the portion 73 is also curved. Also, a recess 73*d* is formed at a position behind (the X2 direction) the connecting portion 75, on the upper edge of the fixed portion 73.

The reinforcing member 70R is integrally formed using metal. For example, a metal plate cut in the shape of the fixed portion 73, pull-out stop portion 71, and the like, is bent at positions where the fixed portion 73 is connected to the connecting portion 75 and where the pull-out stop portion 71 is connected to the connecting portion 75, whereby the reinforcing member 70R can be formed to have the fixed portion 73 and pull-out stop portion 71 both substantially perpendicular to the connecting portion 75.

In the above described electric connector 1, the pull-out stop portion 71, fixed portion 73, connecting portion 75, and stopper portion 76 are formed in the reinforcing member 70R. The pull-out stop portion 71 is positioned in the right direction (the Y1 direction, outside in the width direction of the FPC 80) relative to the plurality of front connection terminals 50 and rear connection terminals 60, and the pull-out stop portion 71 is formed such that the projecting portion 85 can be placed thereon. The stopper portion 76 is formed so that the projecting portion 85 on the pull-out stop portion 71 is caught on the stopper portion 76. The connecting portion 75 extends rightward from the pull-out stop portion 71. The fixed portion 73 fixed on the surface of the circuit board 90 is continuous from the connecting portion 75 and positioned apart from the pull-out stop portion 71 in the right direction. According to the above described electric connector 1, a sufficient distance can be secured between the portion on which the projecting portion 85 is placed (the placement edge 71*a* in the above description) and the portion fixed on the surface of the circuit board 90 (the connection portion 73*a* in the above description). As a result, solder on the fixed portion 73 can be prevented from reaching the placement edge 71*a* due to solder wicking.

Also, as a large distance is secured between the pull-out stop portion 71 and the fixed portion 73, separation of the connection portion 73*a* from the pad 92 can be prevented. That is, when a force to pull off the FPC 80 inserted into the front connection terminals 50 and rear connection terminals 60 acts, the connecting portion 75 becomes bent, whereby the force acting on the connection portion 73*a* is reduced. As a result, separation of the connection portion 73*a* from the pad 92 can be prevented.

Also, the connecting portion 75 formed extending rightward from the upper edge of the pull-out stop portion 71 is positioned at a position anterior to the placement edge 71*a*. With this structure, whether or not the position of the FPC 80 is appropriate can be determined when inserting the FPC 80, depending on whether or not the projecting portion 85 is placed on the connecting portion 75. That is, whether or not the FPC 80 is inserted into an appropriate position can be determined.

Also, the connecting portion 75 is formed like a plate. This makes it more likely that the projecting portion 85 is positioned on the connecting portion 75 when the FPC 80 is not positioned at an appropriate position, and therefore, whether or not the position of the FPC 80 is appropriate can be more accurately determined.

Also, the pull-out stop portion 71 has a pull-out stop portion side press-fitted portion 72 extending backward (the insertion direction of the FPC 80), and the housing 11 has a fitting hole 18, into which the pull-out stop portion side press-fitted portion 72 is pressed. With this structure, even in the case where an electric connector is formed having a low height, it is possible to form a long pull-out stop portion side press-fitted portion 72 of the reinforcing member 70R, and in consequence to more rigidly fix the reinforcing member 70R in the housing 11. For example, compared to a case in which a reinforcing member having a press-fitted portion extending in the height direction (the Z1-Z2 direction) of an electric connector is attached to the housing from above such that the press-fitted portion is pressed into the housing from above, the pull-out stop portion side press-fitted portion 72 can be made longer, and the reinforcing member 70R can be more rigidly fixed in the housing 11.

Also, the fixed portion 73 has a fixed portion side press-fitted portion 74 extending backward (the insertion direction of the FPC 80), and the housing 11 has a hole, into which the fixed portion side press-fitted portion 74 is pressed. With this structure, the reinforcing member 70R can be fixed more rigidly relative to the housing 11.

Note that the present disclosure is not limited to the above described electric connector 1, and is adapted to various modifications. For example, in the above description, the placement edge 71*a*, stopper portion 76, and projecting portion 72*b* of the pull-out stop portion 71 together form a recess, and the projecting portion 85 of the FPC 8 is placed in the recess. However, the position on which the projecting portion 85 is placed is not necessarily in the recess. For example, the pull-out stop portion 71 may have only the placement edge 71*a* and stopper portion 76.

Also, in the above description, the reinforcing members 70R, 70L of the electric connector 1 have one pair of the pull-out stop portion side press-fitted portion 72 and the fixed portion side press-fitted portion 74, and both of these are pressed into the housing 11. However, the reinforcing members 70R, 70L may have only one press-fitted portion.

What is claimed is:

1. An electric connector for connecting a flat electric cable, having a projecting portion formed on a side edge thereof, to a circuit board, the electric connector comprising:

a plurality of terminals, each terminal being arranged in a width direction of the electric cable;

a housing, the housing retaining the terminals; and a reinforcing member, the reinforcing member being attached to the housing;

wherein the reinforcing member includes:

a pull-out stop portion, the pull-out stop portion being positioned outside in the width direction relative to the terminals and formed so that the projecting portion of the electric cable is able to be placed thereon;

a connecting portion, the connecting portion extending from the pull-out stop portion toward the outside in the width direction;

a fixed portion, the fixed portion:

being positioned apart from the pull-out stop portion toward the outside in the width direction, being continuous from the connecting portion, being fixed on a surface of the circuit board, and including a fixed portion side press-fitted portion extending in the insertion direction of the electric cable; and the housing includes a hole into which the fixed portion side press-fitted portion is pressed.

2. The electric connector according to claim 1, wherein the reinforcing member further includes a stopper portion formed so that the projecting portion on the pull-out stop portion is caught on the stopper portion.

3. The electric connector according to claim 2, wherein the pull-out stop portion includes a placement edge formed on an upper edge thereof, on which the projecting portion is able to be placed.

4. The electric connector according to claim 3, wherein the stopper portion is formed on the upper edge of the pull-out stop portion.

5. The electric connector according to claim 4, wherein the connecting portion is positioned anterior to the placement edge in an insertion direction of the electric cable.

6. The electric connector according to claim 5, wherein the connecting portion is formed like a plate.

7. The electric connector according to claim 4, wherein the pull-out stop portion further includes a pull-out stop portion side press-fitted portion extending in an insertion direction of the electric cable.

8. The electric connector according to claim 7, wherein the housing further includes a hole into which the pull-out stop portion side press-fitted portion is pressed.

* * * * *